US005799836A

United States Patent [19]

Lee

[11] Patent Number: 5,799,836

[45] Date of Patent: Sep. 1, 1998

[54] VENTED POURING SPOUT WITH FILTER

[76] Inventor: Huoo-Ke Lee, 1 Fl. No. 25, Alley 17, Lane 12, Pated Rd., Sec. 3, Taipei, Taiwan

[21] Appl. No.: 926,987

[22] Filed: Sep. 10, 1997

[51] Int. Cl.[6] ..... B65D 5/72; B65D 25/48; B67D 3/00

[52] U.S. Cl. ..... 222/189.07; 222/478; 222/567

[58] Field of Search ..... 222/78, 189.07, 222/478, 479, 481, 481.5, 482, 563, 566, 567; 210/467, 469

[56] References Cited

U.S. PATENT DOCUMENTS

| | | | |
|---|---|---|---|
| 242,962 | 6/1881 | Newton | 222/189.07 |
| 1,151,997 | 8/1915 | Beck et al. | 222/479 |
| 2,311,763 | 2/1943 | Lanfare | 222/478 |
| 2,370,668 | 3/1945 | Johnson | 222/189.07 |
| 2,497,134 | 2/1950 | Muenze | 222/479 X |
| 2,605,931 | 8/1952 | Scannell et al. | 222/189.07 X |
| 2,830,731 | 4/1958 | Munao | 222/78 |
| 3,630,419 | 12/1971 | Pierce | 222/567 X |
| 3,926,348 | 12/1975 | Lutzker | 222/189.07 |
| 3,966,099 | 6/1976 | Sanford, Jr. et al. | 222/567 X |
| 4,785,839 | 11/1988 | Du Pree | 222/479 |

*Primary Examiner*—Kevin P. Shaver
*Attorney, Agent, or Firm*—Beveridge, DeGrandi, Weilacher & Young, LLP

[57] ABSTRACT

The present invention relates to a dispensing device generally comprises a plug body, a cap and a straining cup. The plug body is made from soft plastic material and the lower portion of the plug body is provided with a plurality of sealing flanges. The upper portion of the plug body is enveloped with a rigid casing which is provided with an outer thread and in which a directing tube is provided therethrough. The directing tube is projected over the rigid casing and the tip of the tube has an inclined spout. The cap is provided with a sealing element therein and a sealing hole is provided at the bottom center corresponding to the directing tube of the plug body. The bottom of the receiving space is further provided with inner thread which may tightly engage with the outer thread of the plug body. The straining cup is made from a filter which has very fine meshes. The side of the straining cup is provided with a groove. The peripheral of the opening of the cup is provided with a flange which is slightly larger than the outer diameter of the straining cup. With these configuring components, the straining cup can be readily and removably attached to the recess of the plug body. Then the plug body can be inserted and seated within the mouth of the bottle such that a sealing engagement between the mouth and the plug body can be established by those sealing flanges. The inclined spout of the directing tube is projected over the mouth. When the liquid within the bottle is to pour, the outer air can be readily directed in from the ventilating hole while the liquid is screened out with the residues and/or particles. The liquid flow is suitably metered by the directing tube. If there is still some liquid within the bottle, the cap can be tightly sealed the inclined spout to preserve the liquid as the directing tube can be completely sealed by the sealing hole of the cap.

3 Claims, 6 Drawing Sheets

VENTED POURING SPOUT WITH FILTER

FIELD OF THE INVENTION

The present invention relates to a dispensing device, more particularly, to a dispensing device which can be readily mounted onto the existing container for liquid food. By this application of the dispensing device, the liquid can be readily directed outward while the residues can be effectively screened. The dispensing device is further provided with a cap with which the dispensing device can be conveniently sealed to protect the liquid contained within the container.

DESCRIPTION OF PRIOR ART

In the existing containers for liquid food, it can be generally divided into bottles, i.e. glass bottles and PET bottle, and cans, i.e. aluminum cans and tin cans. The present invention is mainly oriented to the bottle containers.

The bottle containers have been largely used for containing the wine, juice, and carbonate soda. There are a variety of the shapes of the bottle containers, a slim, fat or any other shapes. However, the bottle mouth is uniformly formed with an outer diameter about 2 centimeters and from which the liquid contained therein can be poured out.

The existing bottle mouth has a planar top and when the user would like to pour out the liquid contained therein, the following situation may readily be happened.

1. If the bottle container is inclined too fast, the liquid contained therein will flood toward the bottle mouth such that an excess amount of liquid may come out from the mouth. If this is really the case, the excess amount of liquid will cause an overflow to the cup or even flood to the table and floor.
2. It is quite difficult to effectively control the flow of the liquid food since the bottle mouth is planar and the outer diameter of the mouth is comparatively large. If the bottle is not carefully manipulated to have an excess flow, an overflow on the cup is inevitable. Furthermore, if the cup is not large enough, the overflow is surely happened. On the other hand, when the liquid flow comes out from the mouth, it is difficult to predict the central flow of the liquid, as a result, it is difficult to aim the liquid flow to the cup.
3. In order to avoid the situations described in above mentioned sections 1 and 2, the user shall carefully manipulate the bottle such that the bottle shall be inclined slowly to slow down the flow of the liquid. However, this is really laborious and inconvenient.
4. The gas and liquid are all ventilated and flowed out through the same passage, i.e. the bottle mouth. As a result, when the bottle is inclined quickly and violently, the liquid which comes out from the bottle will be mixed and interfered with the air which flows into the container. Accordingly, the liquid may only flow out from the bottle in a intermittent manner. Accordingly, the central flow of the liquid become more and more unpredictable in this case and the overflow become more and more troublesome.

As described above, the bottle containers are used to contain wine, juice and carbonate soda. As a matter of fact, there are some solid residues mixed with the liquid. For example, the juice abstract may contains fibers, seeds and solid flesh. The grape wine or herbal wine may also contain some residues therein. This residues or suspending particles may readily come out together with the liquid contained within the liquid which it comes out. As a result, the user may not get a purified liquid which is free from those residues and particles. This is really not good for taste as well as the quality requirement.

SUMMARY OF THE INVENTION

It is the objective of this invention to provide a dispensing device which can be readily mounted onto the existing bottle containers. By the provision of the present invention, the liquid contained within the bottle can be smoothly poured out in a metered manner. On the other hand, the residues or particles mixed with the liquid can also be effectively screened out.

According to another aspect of the present invention, the dispensing device can be easily manipulated.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
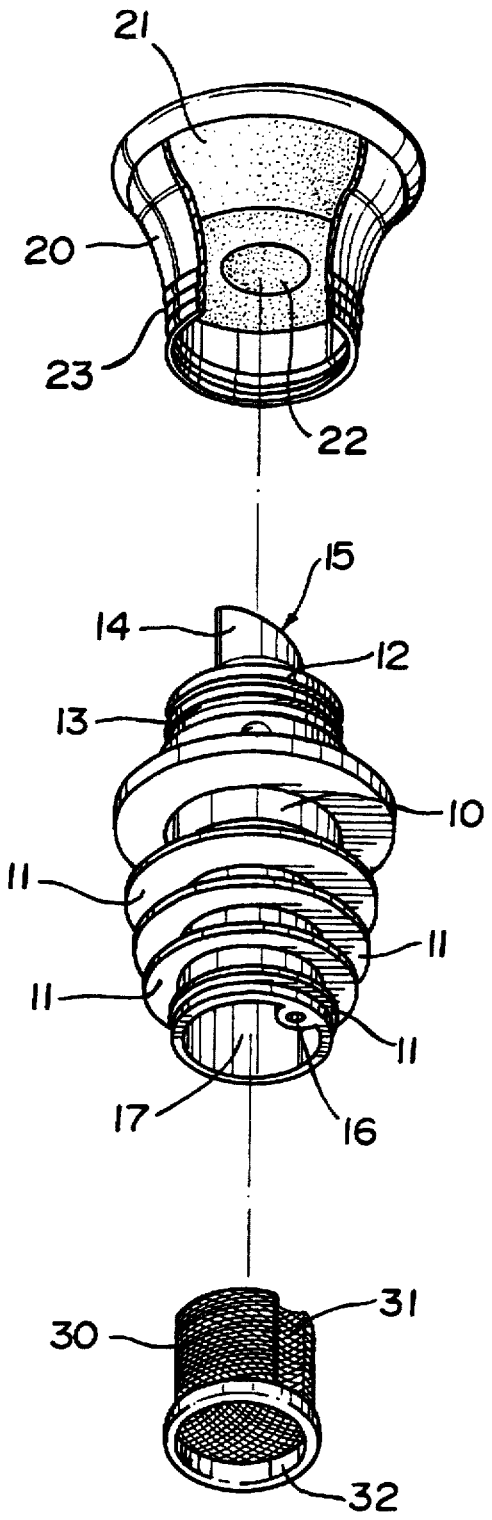
FIG. 1 is an exploded perspective view of the dispensing device made according to the present invention.
Figure 2:
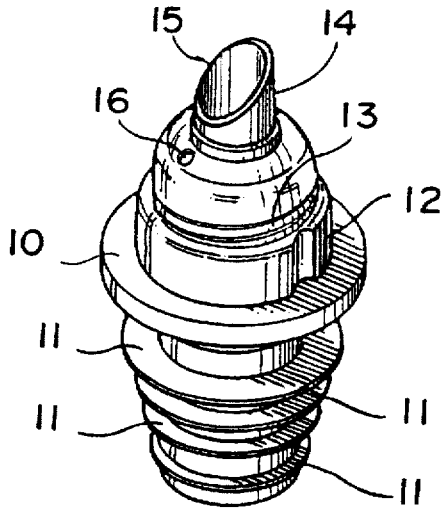
FIG. 2 is a partial, schematic illustration of the dispensing device made according to the present invention.

Referring to FIGS. 1 and 2, the dispensing device generally comprises a plug body 10, a cap 20 and a straining cup 30.

The plug body 10 is made from soft plastic material, such as the rubber, soft PVC etc. The lower portion of the plug body 10 is provided with a plurality of sealing flanges 11 and each of the sealing flanges 11 has different outer diameter. For example, the outer diameters of the flanges 11 are nineteen (19), twenty-two (22), twenty-four (24) and twenty-six (26) minimeters from bottom to top. The upper portion of the plug body is enveloped with a rigid casing 12 which is preferably made from metal or rigid plastic material. The rigid casing 12 is provided with an outer thread 13 and which has a directing tube 14 therethrough, see FIG. 3. The directing tube 14 is projected over the rigid casing 12 and the tip of the tube 14 has an inclined spout 15. The plug body 10 is further provided with a ventilating tube 16 which is opposite to the inclined spout 15. The bottom of the plug body 10 is further provided with a recess 17.

The cap 20 defines a receiving space thereof. The ceiling of the receiving space is provided with a sealing element 21.

The bottom center of the sealing element 21 is provided with a sealing hole 22 corresponding to the directing tube 14 of the plug body 10. The directing tube 14 can be tightly plugged by the sealing hole 22. The bottom of the receiving space is further provided with inner thread 23 which may tightly engage with the outer thread of the plug body 10. The top of the cap 20 can be specially designed with a decorating element 24 according to requirements. This decorating element may serve both the logo and/or identifying mark.

The straining cup 30 is made from a filter which has very fine meshes. The outer diameter of the straining cup 30 is specially designed such that the straining cup 30 can be slightly engaged with the recess 17 of the plug body 10. The side of the straining cup 30 is provided with a groove 31 which is aligned with the ventilating hole 16 of the plug body 10. The peripheral of the opening of the cup is provided with a flange 32 which is slightly larger than the outer diameter of the straining cup 30.

From the above description, because the plug body 10 is provided with a plurality of sealing flanges 11 whose outer diameters range from nineteen (19) to twenty-six (26) minimeters. On the other hand, the outer diameter of the lower portion of the plug body 10 is about sixteen (16) minimeters. As a result, the plug body 10 can be readily mounted onto the bottle mouth of a variety of bottle containers. When the original cap of the bottle 40 is removed, the dispensing device made according to the present invention can be readily applied.

Figure 3:
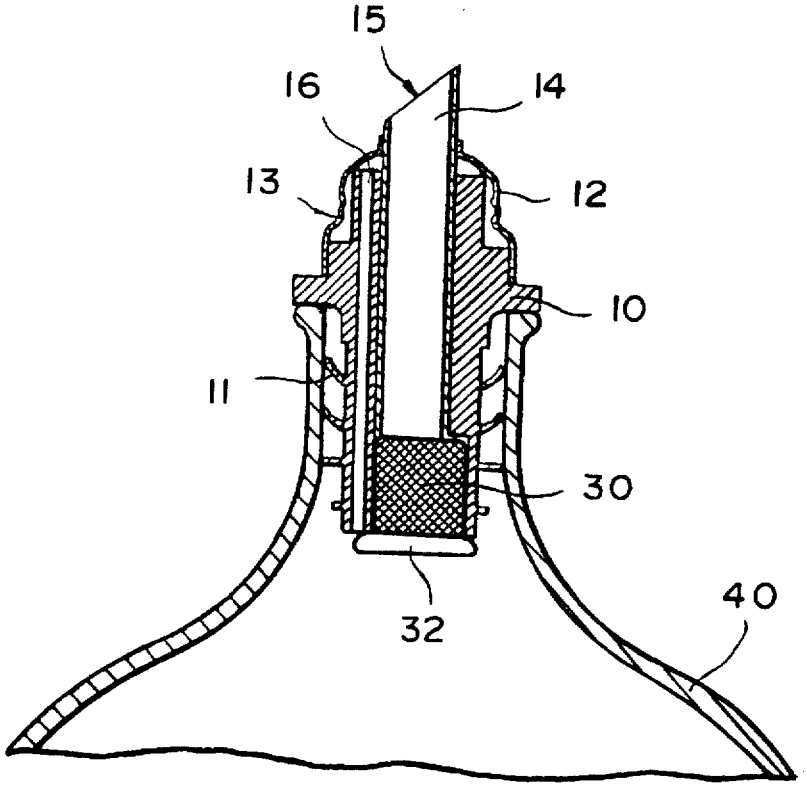
FIG. 3 is a schematic illustration showing the dispensing device is mounted to the bottle container in which the cap is not covered.
Figure 4:
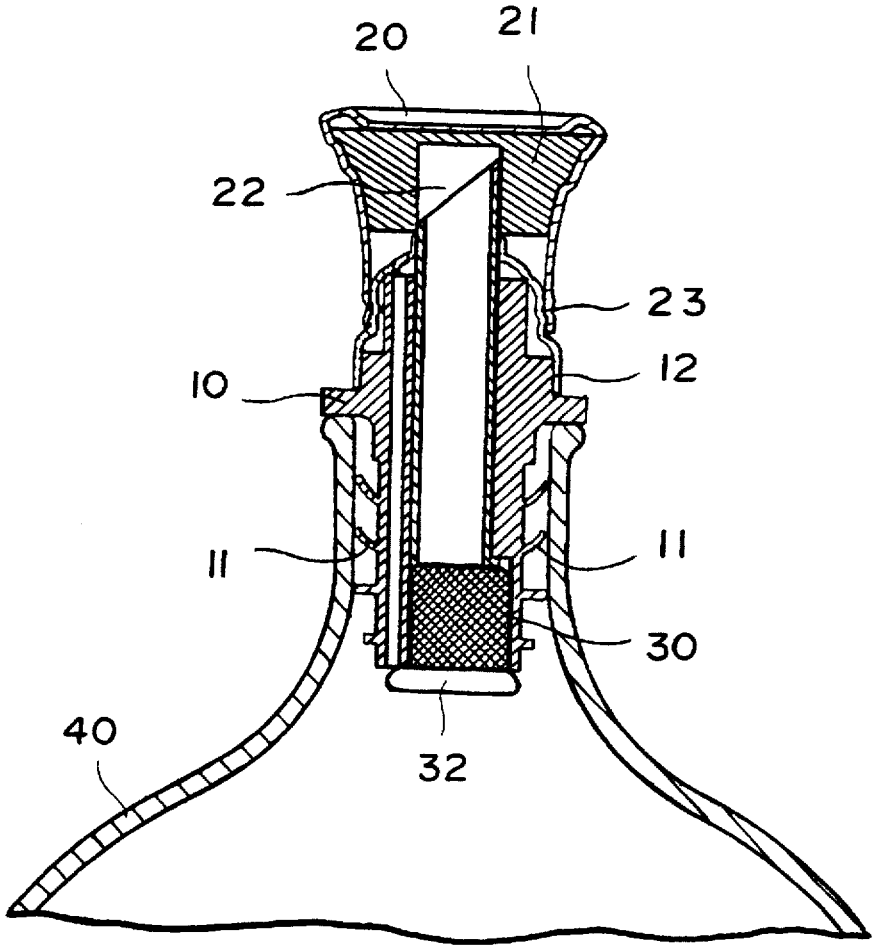
FIG. 4 is a schematic illustration showing the dispensing device is mounted to the bottle container in which the cap has been covered.

Referring to FIG. 3, the straining cup 30 is firstly disposed within the recess 17 of the plug body 10 with the flange 32 directed upward and the groove 31 aligned with the ventilating hole 16. Then the straining cup 30 is further pushed such that the flange 32 is contacted with the bottom of the plug body 10. Because the flange 32 has an curve shape and the ventilating hole 16 will not be blocked. Then the plug body 10 can be inserted into the bottle 40 from the mouth. Because the sealing flanges 11 are made from soft material and which have a plurality of diameters, the mouth can be readily and tightly engaged with the plug body 10 without any leakage thereof. After the plug body 10 is seated, the lower portion of the plug body 10 is seated within the mouth and which is visible. On the other hand, the casing 12 is disposed over the mouth while the front tip of the directing tube 14 is projected over the center of the casing 12.

Since the bottle 40 is provided with a dispensing device in its mouth, as shown in FIG. 3, the dispensing device can also be sealed with a cap 20 which can be threaded onto the plug body 10 by the threaded engaged between the inner thread 23 and outer thread 13. When the cup 20 is tightly seated, the sealing hole 22 of the sealing element 21 can enclosed completely of the directing tube 14 of the plug body 10. This is attained firstly the sealing element 21 is made from soft material; and secondly, there is an interference engagement between the inner diameter of the sealing hole 22 and the outer diameter of the directing tube 14. By this arrangement, the directing tube 14 can be tightly sealed by the sealing hole 22. As a result, the liquid food contained within the bottle can be suitably preserved.

Figure 5:
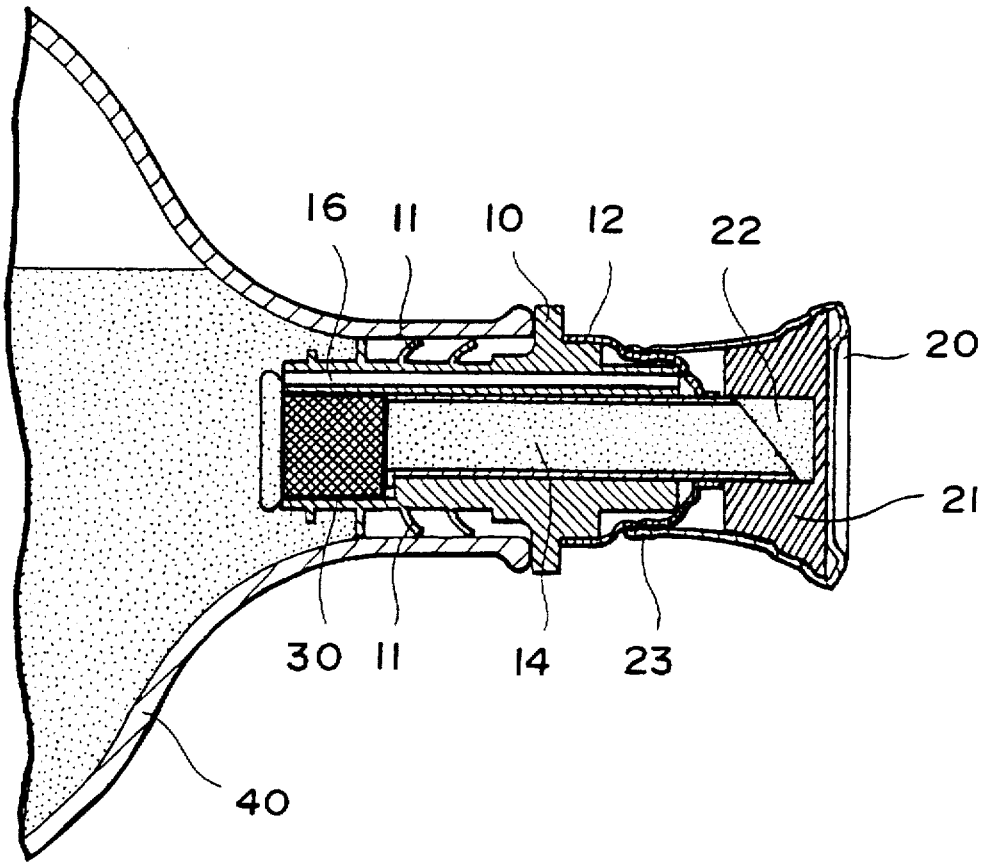
FIG. 5 is a schematic illustration in which the bottle container having mounted with the dispensing device has been lied down.

As shown in FIG. 5, even the bottle 40 is lied horizontally, as shown in FIG. 5, however, as the directing tube 14 is tightly sealed by the sealing element 21, there is no convention between the directing tube 14 and the ventilating hole 16. By this arrangement, the liquid contained within the bottle 40 can be effectively prevented therefrom. Not only will the bottle be kept in cleaning condition, but also will keep the environment clean.

Figure 6:
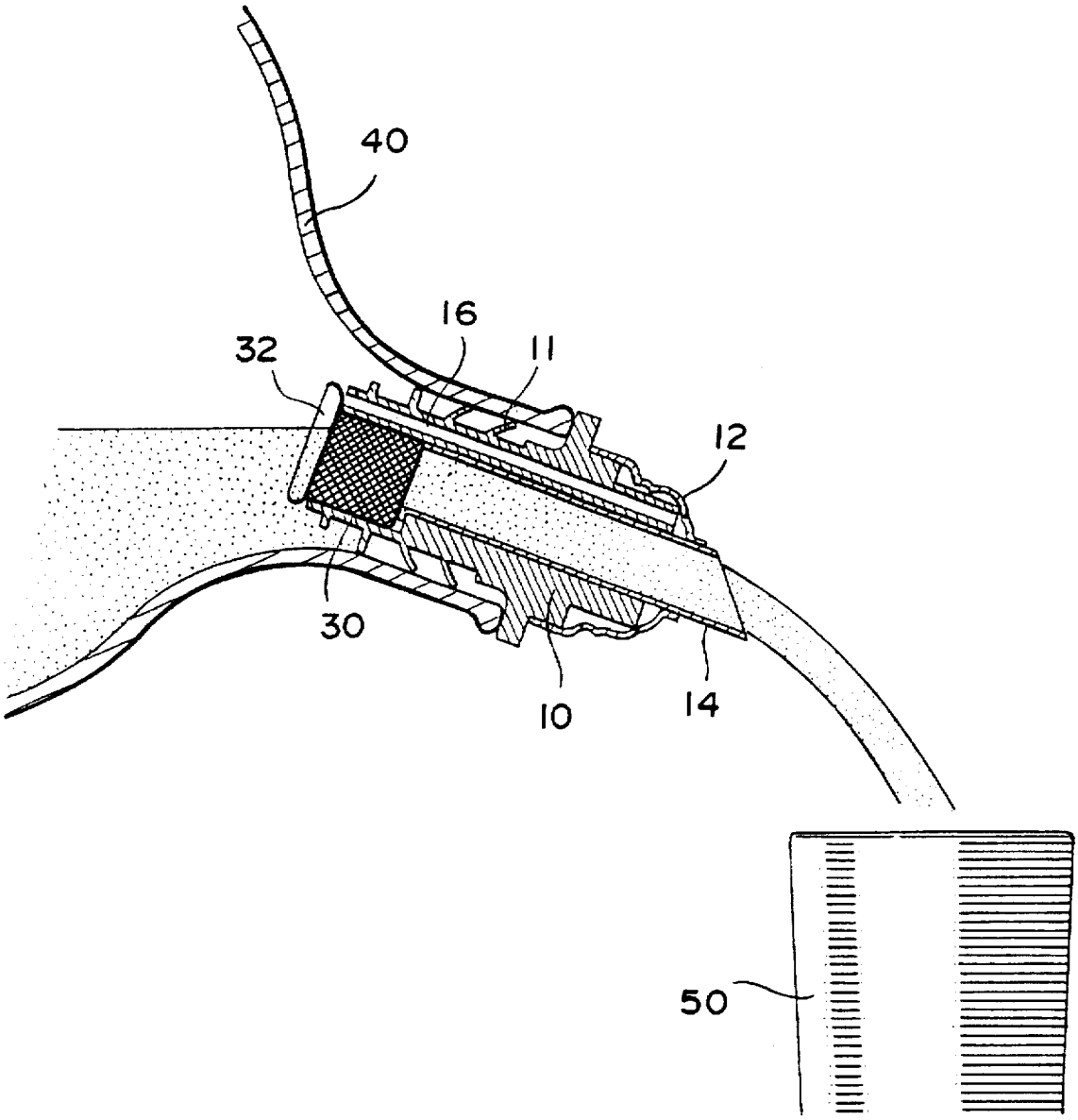
FIG. 6 is still a schematic illustration in which the bottle container is inclined to pour out the liquid contained therein.

When the user hopes to drink the liquid contained therein, as shown in FIG. 6, the cap 20 can be firstly removed and hold on the bottle 40 to pour out the liquid. In use, the inclined spout 15 of the directing tube 14 is directed downward and the ventilating hole 16 is disposed at top position. Then the user may direct the directing tube 14 toward the cup 50. Since the air can suitably flow into the bottle 40 via the ventilating hole 16, a convention is occurred between the ventilating hole 16 and the directing tube 14. Then the liquid contained in the bottle 40 will firstly filtered by the straining cup 30 to screen out the residues and particles mixed with the liquid with the very fine meshes. Then the purified liquid is directed by the directing tube 14 to the cup 50 from the inclined spout 15. Once the bottle 40 is hold vertically, the liquid is stopped immediately.

From the forgoing description, the present invention can be concluded with the following advantages.

Figure 7:
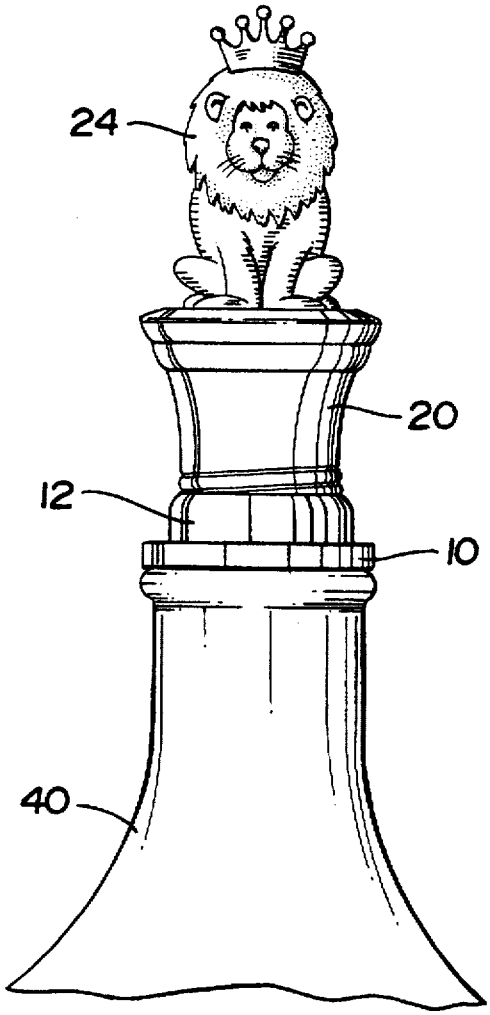
FIG. 7 is a schematic illustration in which a decoration has been installed onto the dispensing device made according to the present invention.

1. When the bottle container is mounted with the dispensing device made according to the present invention, the liquid contained therein can be poured out in a metered manner because the inner diameter of the mouth of the bottle 40 is narrowed to eight (8) minimeters by the directing tube 14. As a result, the liquid will not flood out from the mouth as the flow rate is metered by the directing tube 14.
2. As there is a ventilating hole 16, the air can be suitably ventilated between from the atmosphere and the bottle. Since a smooth convention is generated, the flow rate is smoothly and suitably metered. The intermittent and shifting of the flow are therefore prevented.
3. When the liquid flows out from the directing tube 14, it is suitably directed by the inclined spout 15. Accordingly, the direction of the liquid flow is suitably directed. No mater what the size of the cup 50 may be, the liquid can accurately directed into the cup without any possibility of overflow or scattering.
4. When the liquid is poured out, the liquid is firstly screened by the straining cup 30, the residues and/or particle mixed with the liquid can be effectively screened and the user may enjoy the purified liquid with excellent taste and flavor. On the other hand, the straining cup 30 can be readily and removably assembled with the plug body 10. The user may readily mount the dispensing device onto the bottle. Besides, the straining cup 30 can be selectively mounted or dismounted.
5. Since the engagement between the dispensing device and the bottle 40 can be readily and removably made, the dispensing device can be readily mounted onto different bottle 40. Once the cap of the bottle 40 is removed, the dispensing device made according to the present invention can be mounted. After the liquid is exhausted, the dispensing device can be removed and mounted to another bottle 40. The dispensing device can be repetitively used.
6. Since the plug body 10, the cap 20, the straining cup 30 are removably assembled, it can be readily disassembled for cleaning process. As a result, the user may frequently clean those components after a period of usage or even after a single use. By this arrangement, not only will the cleaning condition can be ensured, the flavor and taste of different liquids will not be interfered or mixed from each other. As a result, the flavor and taste of each liquid can be ensured.
7. The top of the cap 20 can be also provided with a decorating element 24 for special liquids, for example, the wine. Some special bottle may also has a special decorating element 24, as shown in FIG. 7. This decorating element 24 can be a brand or trademark or an identifying logo.

8. Not only will the dispensing device be applied to the bottle for liquid food, but also will this dispensing device be applied tot the bottle for medicine, chemicals and liquid oils. The outer diameter of the plug body 10 sealing flanges 11 can be readily modified to meet the requirements. As a result, any kind of bottle can be mounted with a suitable dispensing device suggested by the present invention.

From the forgoing description, it can be readily appreciated that the conventional problems can be completely solved by the provision of the dispensing device suggested by the present invention. On the other hand, a great improvement on the pouring of the liquid from the bottle is attained. While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A dispensing device for bottle container, comprising:

a plug body which is made from soft plastic material, the lower portion of said plug body being provided with a plurality of sealing flanges, the upper portion of said plug body being enveloped with a rigid casing which is provided with an outer thread, a directing tube being disposed at the central portion, said directing tube being projected over said rigid casing and the tip of said tube being provided with an inclined spout, said plug body being further provided with a ventilating tube which is opposite to said inclined spout, the bottom of said plug body being further provided with a recess;

a cap which defines a receiving space thereof, the ceiling of said receiving space being provided with a sealing element which is provided with a sealing hole at the bottom center corresponding to said directing tube of said plug body, the bottom of said receiving space being further provided with inner thread which may tightly engage with said outer thread of said plug body, wherein when said cap is seated, said directing tube of said plug body can be sealed by said sealing hole;

a straining cup which is made from a filter which has very fine meshes, the outer diameter of said straining cup being specially sized such that said straining cup can be slightly engaged with said recess of said plug body, the side of said cup being provided with a groove which is aligned with said ventilating hole of said plug body, the peripheral of said opening of said straining cup being provided with a flange which is slightly larger than the outer diameter of said straining cup.

2. A dispensing device for bottle container as recited in claim 1, wherein the outer diameter of said sealing flanges of said plug body is increased from bottom to top.

3. A dispensing device for bottle container as recited in claim 1, wherein the top of said cap is provided with a decorating element.

* * * * *